US008653760B1

(12) United States Patent
Pearce et al.

(10) Patent No.: US 8,653,760 B1
(45) Date of Patent: Feb. 18, 2014

(54) ELECTRIC TEA LIGHT DEVICE

(76) Inventors: Tim C. Pearce, San Jose, CA (US); Tracy A. Pearce, San Jose, CA (US)

( * ) Notice: Subject to any disclaimer, the term of this patent is extended or adjusted under 35 U.S.C. 154(b) by 480 days.

(21) Appl. No.: 12/939,750

(22) Filed: Nov. 4, 2010

(51) Int. Cl.
*H05B 37/02* (2006.01)
*H05B 39/04* (2006.01)
*H05B 41/36* (2006.01)

(52) U.S. Cl.
USPC ..... 315/360

(58) Field of Classification Search
None
See application file for complete search history.

(56) References Cited

U.S. PATENT DOCUMENTS 5,650,673 A * 7/1997 Maeda ..... 307/141.4
6,736,531 B2 5/2004 Wallach
7,011,426 B2 3/2006 Gabor
7,038,594 B2 * 5/2006 Voreis et al. ..... 340/815.45
D557,450 S 12/2007 Barbeau et al.
7,387,411 B1 6/2008 Tsai
2005/0128743 A1 * 6/2005 Chuey et al. ..... 362/234
2005/0174784 A1 8/2005 Conrey
2006/0125420 A1 * 6/2006 Boone et al. ..... 315/291
2006/0175426 A1 * 8/2006 Schramm et al. ..... 239/69
2007/0183144 A1 8/2007 Van Ulmer et al.
2008/0025028 A1 * 1/2008 Gloisten et al. ..... 362/294
2008/0094825 A1 * 4/2008 Silver ..... 362/161

* cited by examiner

*Primary Examiner* — Douglas W Owens
*Assistant Examiner* — Dedei K Hammond

(57) ABSTRACT

A programmable electric tea light device. The device features a light component mounted on a base. The brightness of the light component is adjustable via a potentiometer. A brightness adjustment control button is operatively connected to the potentiometer. The brightness adjustment control button functions to adjust brightness of the light component. Circuitry and a power source are both operatively connected to the light component. The circuitry comprises a timer and a memory component. The device also features a one-button programming interface for programming the timer to cause the light component to turn on and off at one or more times during a 24-hour period.

1 Claim, 3 Drawing Sheets

ELECTRIC TEA LIGHT DEVICE

FIELD OF THE INVENTION

The present invention is directed to small tea lights, more particularly to a programmable electric tea light with a high-brightness light such as a light emitting diode.

BACKGROUND OF THE INVENTION

Electric candles are commonly used for decorative purposes, for example atop a mantle, in a fireplace, in a bedroom, or even in a pumpkin. However, electric candles may be too dim and lack timer functions so a user has to remember to turn it on and off. The present invention features a novel programmable electric tea light comprising a programmable timer that repeats the programmed settings every 24 hours. The electric tea light features a high-brightness light (e.g., light emitting diode) with an adjustable amplifier. The electric tea light of the present invention is small enough to be placed in a pumpkin yet can light up a small room if desired.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a programmable electric tea light device. In some embodiments, the device comprises a light component mounted on a base, the light component is a high-brightness light, wherein brightness of the light component is adjustable via a potentiometer; a brightness adjustment control button operatively connected to the potentiometer, the brightness adjustment control button functions to adjust brightness of the light component; circuitry and a power source each operatively connected to the light component, the circuitry comprises a timer and a memory component; and a one-button programming interface for programming the timer to cause the light component to turn on and off at one or more times during a 24-hour period.

In some embodiments, the light component is a light emitting diode (LED). In some embodiments, the light component may be constructed having a color including red, green, yellow, blue, purple, pink, white, or a combination thereof. In some embodiments, the light component comprises multiple lights. In some embodiments, the potentiometer is a 50 K ohm potentiometer or a 100 ohm potentiometer.

In some embodiments, the power source is a battery. In some embodiments, the circuitry comprises an 8 bit controller. In some embodiments, the circuitry comprises a transistor and a resistor. In some embodiments, the memory component includes electrically erasable programmable read-only memory (EEPROM), flash memory, and static random access memory (SRAM).

In some embodiments, the circuitry is operatively connected to an amplifier, the amplifier is operatively connected to the light component. In some embodiments, the programmable electric tea light device further comprises an on/off switch. In some embodiments, turning on the programmable electric tea light device both turns on the light component and resets a timer value of the timer.

DESCRIPTION OF PREFERRED EMBODIMENTS

Referring now to FIG. 1-4, the present invention features a novel programmable electric tea light device 100 comprising a programmable timer that repeats the programmed settings every 24 hours so that a user does not need to remember to turn the light on and off. For normal operation of the device 100 of the present invention, the device 100 is first turned on. In some embodiments, turning the device 100 on resets all timer values. The light component 110 will turn on at this time. When a user is ready to change the light component 110, the timer on/off button is pressed. The device 100 of the present invention will repeat the above on/off times each day. In some embodiments, to override the settings, the manual over-ride button is pressed. The light component 110 will turn on or off. In some embodiments, the device 100 resumes previous settings.

The electric tea light device 100 of the present invention comprises a light component 110 mounted on a base. The light component 110 is a high-brightness light, for example a light emitting diode (LED). The light component 110 may be constructed having one or more colors, for example red, green, yellow, blue, purple, pink, white, etc. The present invention is not limited to the aforementioned colors. The brightness of the light component 110 may be adjustable (e.g., via potentiometers).

Figure 1:
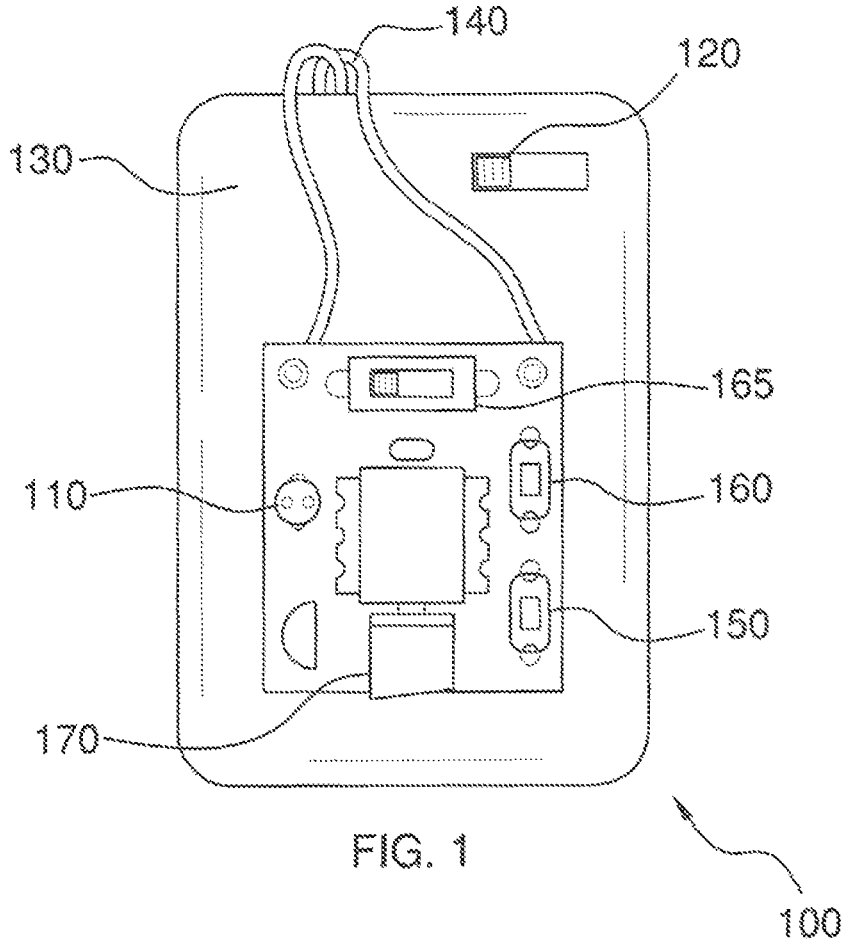
FIG. 1 is a top view of the electric tea light device of the present invention.
Figure 2:
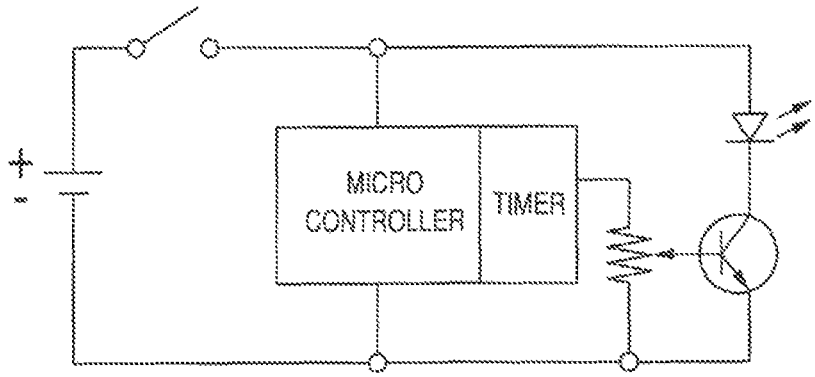
FIG. 2 is a schematic view of electrical circuitry of the electric tea light device of the present invention.
Figure 3:
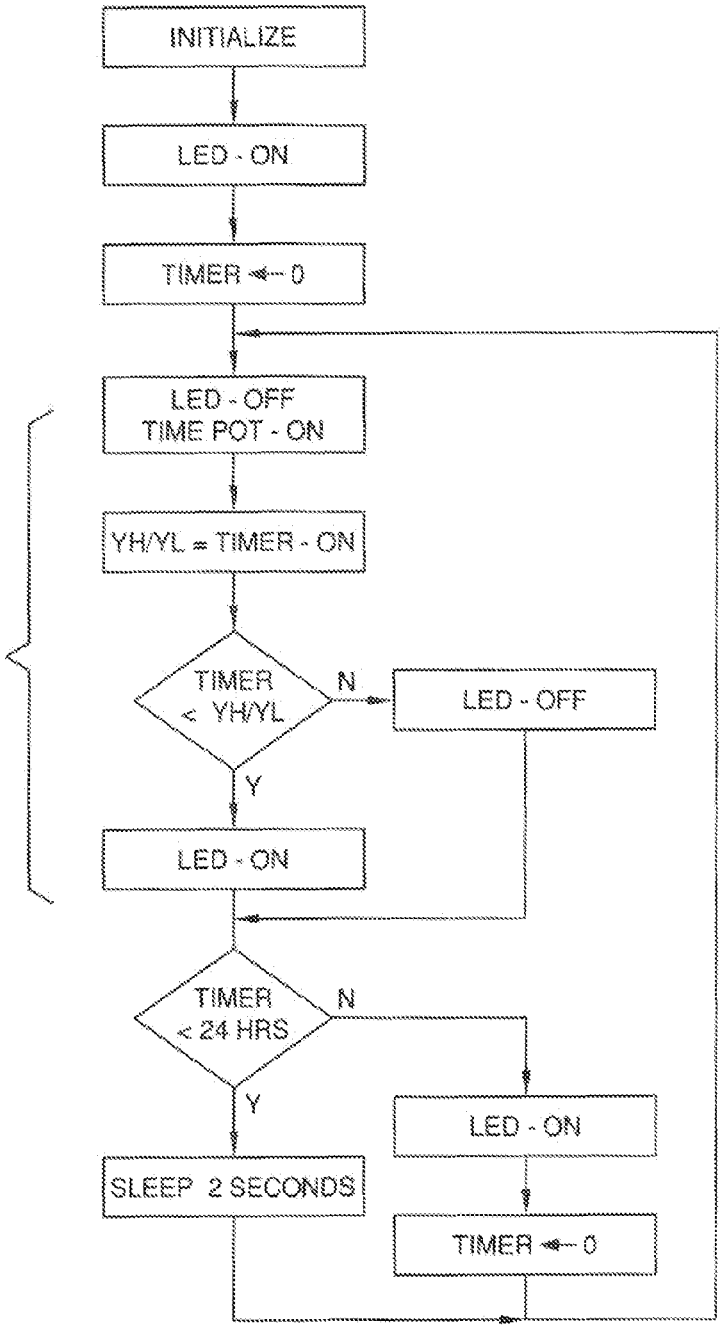
FIG. 3 is a flow chart of software and programming of the electric tea light device of the present invention.

The device 100 of the present invention further comprises circuitry (with a microprocessor or variation thereof, such processors and variations are well known to one of ordinary skill in the art) and a power source 130 each operatively connected to the light component 110. As shown in FIG. 1, the power source 130 is operatively connected to the circuitry and the light component 110 via wires 140. In some embodiments, the power source 130 is one or more batteries (e.g., standard batteries such as AA, coin-sized batteries, rechargeable batteries, etc.). The power source is not limited to the aforementioned examples.

The device 100 of the present invention also features a timer for programming the light component 110 to be turned on and off at a particular time, for example within a 24 hour period. In some embodiments, the device 100 can be programmed to turn on and off the light component 110 multiple times within a 24 hour period. In some embodiments, the device 100 can be programmed to turn on and off the light component 110 various different times within a set of days (e.g., a week), for example the light component 110 can be activated at a particular time (or times) during weekdays and a different time (or times) during weekend days. Multiple push buttons may be incorporated (or other mechanisms) for programming for multiple days and/or times. In some embodiments, the values (on/off times) are stored in memory or additional registers are added (e.g., each on/off value requires 3 bytes/3 registers).

The device 100 may feature a one-button programming interface for programming the device 100 to turn on and off the light component 110 at a particular time (or times). In some embodiments, the device 100 of the present invention also comprises an on/off switch 120.

Circuitry may include but is not limited to an 8 bit controller, potentiometers (e.g., 50 K ohm, 100 ohm, etc.), transistor (s), resistor(s) (e.g., 12 ohm, etc.). The potentiometers may function to adjust the on time and/or adjust the light brightness.

In some embodiments, the device 100 is designed as a multiple light version (e.g., four LED version), wherein one light blends into the next. The color sequence may be varied, for example yellow, green, red, and blue.

Figure 4:
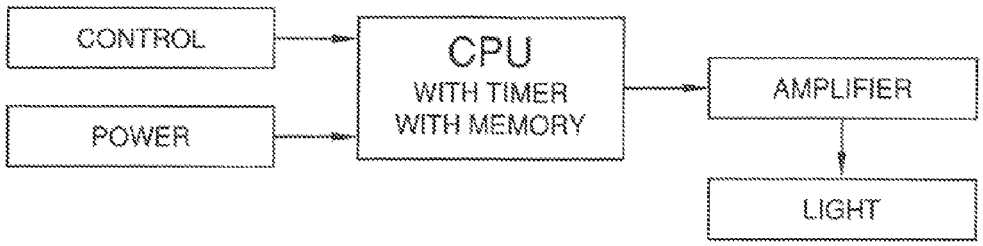
FIG. 4 is a schematic view of electrical components of the electric tea light device of the present invention.

Referring now to FIG. 1, the device 100 comprises a light component 110, a power source 130 with wires 140, a timer on/off button 150, a manual override button 160, an on/off switch reset timer 165, and a control 170 (for brightness adjustment). An example of the circuitry of the device 100 of the present invention can be found in FIG. 2. The present invention is not limited to the circuitry described in FIG. 2. The device 100 of the present invention is programmed with software for achieving a timer function. An example of programming software can be seen in FIG. 3. The present invention is not limited to the programming described in FIG. 3. Referring now to FIG. 4, the control and power source are operatively connected to the microprocessor (e.g., CPU with timer, with memory), which is operatively connected to an amplifier. The amplifier is operatively connected to the light component 110.

Memory components used in the device 100 of the present invention may include but are not limited to electrically erasable programmable read-only memory (EEPROM), flash memory, static random access memory (SRAM), or other types of memory or variations thereof.

Without wishing to limit the present invention to any theory or mechanism, it is believed that the electric tea light device 100 of the present invention is advantageous because it features a programmable timer (24 hour repetitions), a one-button control mechanism, a bright light, and multiple color options.

The disclosures of the following U.S. Patents are incorporated in their entirety by reference herein: U.S. Pat. No. 7,011,426; U.S. Pat. No. 7,387,411; U.S. Pat. No. 6,736,531; U.S. Pat. Application No. 2007/0183144; U.S. Pat. Application No. 2005/0174784; U.S. Design Pat. No. D557,450.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A programmable electric tea light device consisting of:

(a) a light component mounted on a base, the light component is a light emitting diode (LED), wherein brightness of the light component is adjustable via a potentiometer;

(b) a brightness adjustment control button operatively connected to the potentiometer, the brightness adjustment control button functions to adjust brightness of the light component;

(c) circuitry and a power source each operatively connected to the light component, the circuitry consists of a timer and a memory component; and (d) a one-button programming interface for programming the timer to cause the light component to turn on and off at one or more times during a 24-hour period.

* * * * *